United States Patent [19]

Iwai

[11] 4,075,985

[45] Feb. 28, 1978

[54] TWO CYCLE INTERNAL COMBUSTION ENGINES

[75] Inventor: Tomio Iwai, Iwata, Japan

[73] Assignee: Yamaha Hatsudoki Kabushiki Kaisha, Iwata, Japan

[21] Appl. No.: 697,681

[22] Filed: Jun. 18, 1976

[30] Foreign Application Priority Data

Jun. 20, 1975 Japan ..... 50-86128[U]
Jun. 20, 1975 Japan ..... 50-86129[U]

[51] Int. Cl.[2] ..... F02B 33/04

[52] U.S. Cl. ..... 123/73 A; 123/73 R; 123/73 B; 123/59 B

[58] Field of Search ..... 123/65 B, 65 BA, 65 E, 123/59 B, 65 A, 73 R, 73 A, 73 B

[56] References Cited

U.S. PATENT DOCUMENTS

| | | | |
|---|---|---|---|
| 1,022,664 | 4/1912 | Ellis | 123/73 B |
| 1,029,398 | 6/1912 | Powell | 123/73 C |
| 1,096,819 | 5/1914 | Ahlberg | 123/73 B |
| 1,722,951 | 7/1929 | Barkeij | 123/59 B |
| 2,317,772 | 4/1943 | Huber et al. | 123/73 A |
| 2,481,901 | 9/1949 | Bracke | 123/73 R |
| 3,107,659 | 10/1963 | Steinlein et al. | 123/73 R |

*Primary Examiner*—Charles J. Myhre
*Assistant Examiner*—David D. Reynolds
*Attorney, Agent, or Firm*—Harold L. Stowell

[57] ABSTRACT

Crank-chamber precompression type two cycle engines having scavenging ports connected with the crank-chamber through scavenging passages. An air supply passage is connected through a reed type check valve with at least one of the scavenging passages at the upper portion thereof so that air is introduced into the scavenging passage in the ascending stroke of piston movement and discharged into the combustion chamber in the descending stroke of the piston movement to effect scavenging. The air passage is provided with a control valve which is interconnected with the engine throttle valve so that the amount of air supply through the air passage can be controlled in accordance with the load condition of the engine operation.

7 Claims, 8 Drawing Figures

TWO CYCLE INTERNAL COMBUSTION ENGINES

The present invention relates to internal combustion engines and more particularly to crank-chamber pre-compression type two cycle engines.

In this type of two cycle engines, cylinders are formed with scavenging ports and exhaust ports which are adapted to be cyclically opened to combustion chambers defined in the cylinders by means of pistons which reciprocate in the cylinders. The scavenging ports are connected through scavenging passages with crank-chambers to which air-fuel mixture is introduced through intake passages. In descending stroke of piston movements, the exhaust ports are opened first to allow combustion gas in the combustion chambers to flow out of the cylinders. Thereafter, the scavenging ports are opened so that the air-fuel mixture which has been compressed in the crank-chambers by the downward movements of the pistons is forced through the scavenging passages into the combustion chambers to scavenge the combustion chambers by expelling combustion gas therefrom.

In this type of engines, it has been experienced that, in the scavenging stroke of engine operation, particularly in the beginning part of the scavenging stroke, appreciable amount of scavenging fluid, that is, unburnt air-fuel mixture is allowed to flow out of the combustion chambers through the exhaust ports resulting in an increase in pollutant emissions.

In order to eliminate the problem, it has been proposed, by Japanese Patent Application Sho 46-59747 which has been disclosed under the disclosure number of Sho 48-24118, to additionally provide a scavenging air port in the engine cylinder in such a position that it is opened during descending stroke of piston movements prior to the conventional scavenging ports so that air is at first introduced into the combustion chamber to expel combustion gas therefrom.

In another proposal, arrangements are made in such a way that air is introduced during ascending stroke of piston movement into the upper parts of the scavenging passages and stored in the areas. In the succeeding piston descending stroke, the air thus stored in the upper parts of the scavenging passages is injected into the combustion chamber as soon as the scavenging ports have been opened to scavenge the combustion chamber. An example of the arrangement can be found in the report by H. E. Fandrich in Department of Mechanical Engineering in Stanford University in California, published by Technical Report No. S-1.

In these known designs, however, no particular means has been provided for controlling the amount of scavenging air in response to the engine operating condition. Therefore, when the air supply device is so designed that it provides supply of air in the amount desirable for high load engine operation, the air-fuel mixture may undesirably be diluted in the combustion chamber during the idling or light load engine operation possibly resulting in misfire or rough engine operation. When the design of the air supply device is such that it supplies scavenging air in the amount desirable for idling or light load engine operation, adequate amount of air will not be supplied in high load operation.

It is therefore a primary object of the present invention to provide two cycle internal combustion engines having scavenging air supply means for providing supply of scavenging air which varies in accordance with engine operating conditions.

Another object of the present invention is to provide novel arrangements of scavenging air supply means.

A further object of the present invention is to locate the scavenging air supply means in such positions that the means does not interfere with flow of air-fuel mixture.

Still further object of the present invention is to provide novel scavenging air supply arrangements by which discharge of unburnt air-fuel mixture can be minimized.

According to the present invention, the above and other objects can be accomplished by a two cycle internal combustion engine comprising cylinder means, piston means disposed for sliding movement in said cylinder means and defining combustion chamber means of variable volume in one end of said cylinder means, crankcase means provided at the other end of the cylinder means and defining therein crank-chamber means having a volume which varies in response to the sliding movement of the piston means, exhaust port means formed in said cylinder means and connected with exhaust passage means, scavenging port means formed in said cylinder means, scavenging passage means having one end connected with said scavenging port means and the other end with said crank-chamber means, air passage means communicating through check valve means with the scavening passage means for providing supply of air thereto, intake passage means communicating with the crank-chamber means and having throttle valve means provided therein, control valve means provided in said air passage means, means for actuating the control valve means so that it is opened in accordance with engine load condition.

In a preferred aspect of the present invention, the control valve means is mechanically interconnected with the throttle valve means so that the former is opened in accordance with the opening of the latter. However, it should be noted that the control valve may be actuated in accordance with engine intake pressure.

According to a further feature of the present invention, the cylinder means is provided with second scavenging port means connected through second scavening passage means with the crank-chamber means. The second scavenging port means is located in such a position that it is opened in descending stroke of engine operation later than the first scavenging port means. Preferably, the first scavening port means includes a port located in the cylinder wall at the side opposite to the exhaust port and the second scavenging port means includes a pair of ports provided one at each side of the exhaust port.

In the arrangement where the scavenging port means includes a pair of or a pair groups of scavenging ports located at the opposite sides with respect to the exhaust port and the air passage means is connected with each of the scavenging passages leading to the ports, it is preferred that the air passage opens to the associated scavenging passage at the wall surface thereof which does not in effect serve to guide the mixture flow passing therethrough.

The above and other objects and features of the present invention will become apparent from the following descriptions of preferred embodiments taking reference to the accompanying drawings, in which.

Figure 2:
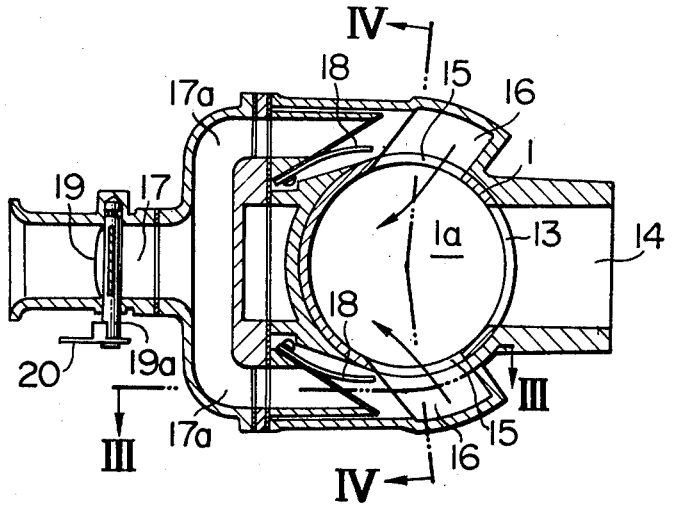
FIG. 2 is a horizontal section of the engine shown in FIG. 1, the section being taken along the line II—II in FIG. 1.
Figure 3:
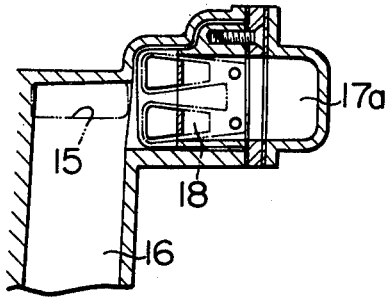
Figure 4:
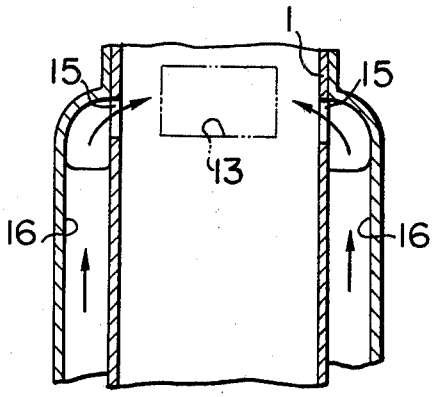
Figure 5:
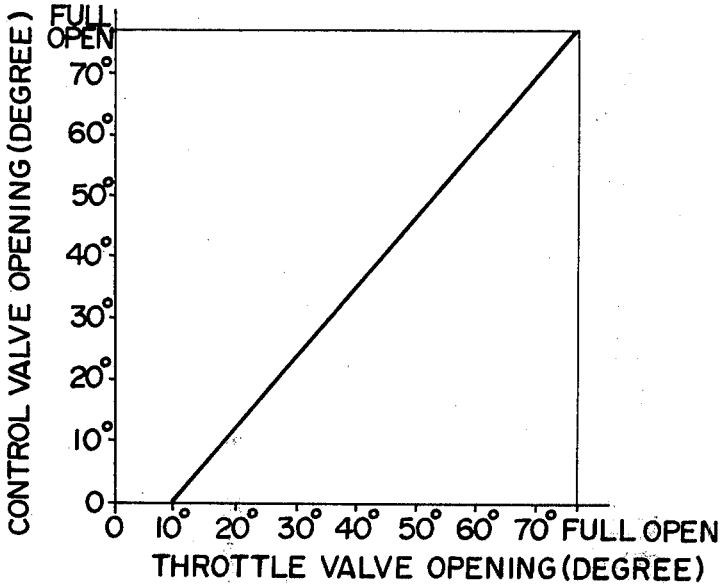
Figure 6:
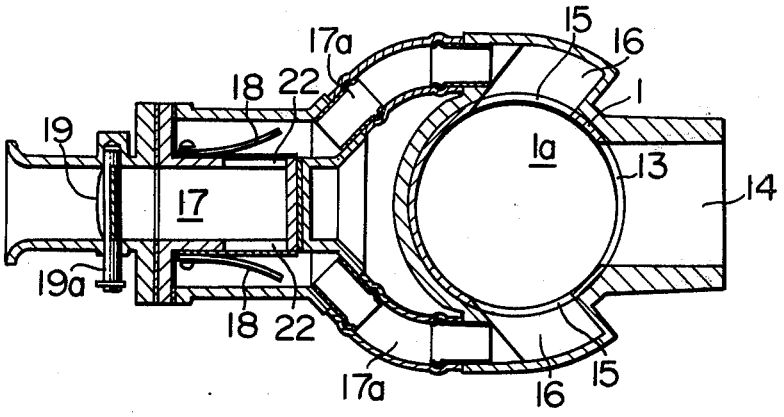
Figure 7:
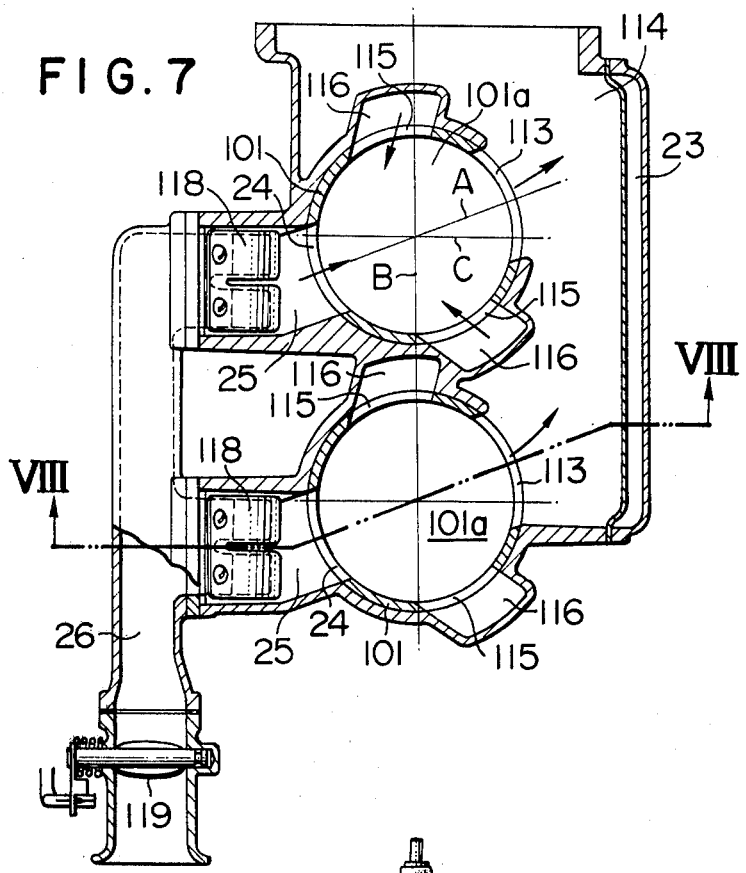
Figure 8:
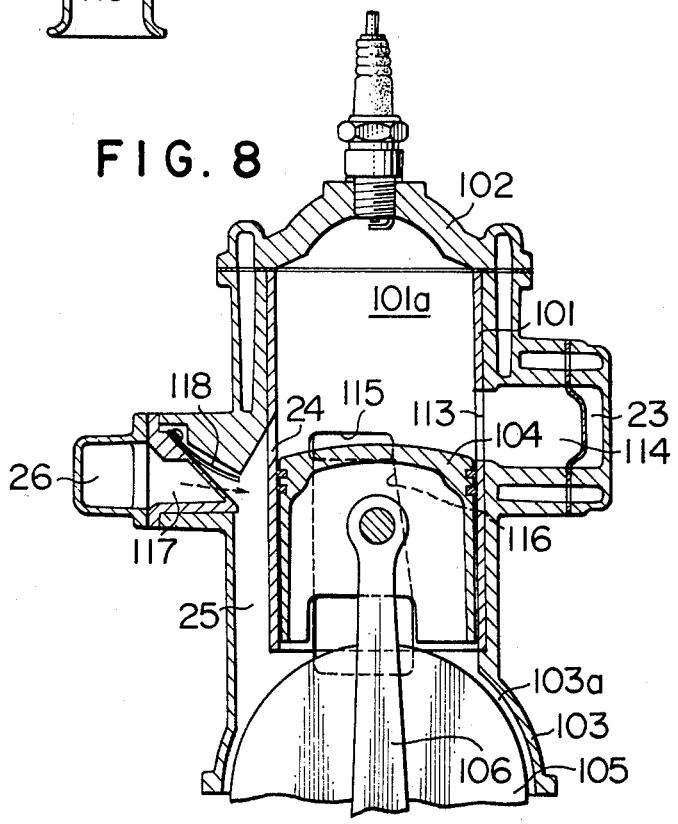

FIG, 3 is a fragmentary sectional view taken substantially along the line III—III in FIG. 2;

FIG. 4 is a fragmentary sectional view taken substantially along the line IV—IV in FIG. 2;

FIG. 5 is a diagram showing the relationship between the throttle valve and the air control valve;

FIG. 6 is a horizontal sectional view of an engine in accordance with another embodiment of the present invention;

FIG. 7 is a horizontal sectional view of a multiple cylinder engine in accordance with another embodiment of the present invention; and FIG. 8 is a sectional view taken substantially along the line VIII—VIII in FIG. 7.

Referring now to the drawings, particularly to FIGS. 1 through 4, the engine shown therein includes a cylinder 1 with a cylinder head 2 attached to the top end of the cylinder 1. At the bottom end of the cylinder 1, there is provided a crankcase 3 which defines therein a crank-chamber 3*a*. A piston 4 is disposed in the cylinder for slidable reciprocating movement and defines a combustion chamber 1*a* with the cylinder 1 and the cylinder head 2.

In the crank-chamber 3*a*, there is disposed a crankshaft 5 which is connected with the piston 4 through a connecting rod 6. The crankcase 3 is formed with an intake port 7 which is in communication with an intake passage 8 having a reed type check valve 9 disposed therein. A known type of carburetor 10 is provided and has a passage 10*a* which is in communication with the intake passage 8. As conventional in the art, the carburetor 10 has a throttle valve 11 disposed in the passage 10*a*. The throttle valve 11 has an actuating shaft 11*a* secured thereto and having an outer end to which a throttle actuating lever 12 is secured.

The cylinder 1 is formed with an exhaust port 13 leading to an exhaust passage 14. The cylinder 1 is further formed with a pair of scavenging ports 15 which are disposed one on each side of the exhaust port 14 as clearly seen in FIGS. 2 and 4. Each of the scavenging ports 15 is connected with a scavenging passage 16 which leads to the crank-chamber 3*a*. The exhaust and scavenging ports 13 and 15 are adapted to co-operate with the piston 4 so that they are timely opened in response to the movement of the piston 4. As conventional in the art, the scavenging ports 15 are located with respect to the exhaust port 13 in such a manner that in descending stroke of the piston movement the scavenging ports 15 are opened later than the exhaust port 13.

The engine is further provided with an air inlet passage 17 which is branched as seen in FIG. 2 into two branch passages 17*a* which communicates with respective ones of the scavenging passages 16 at the upper portions thereof. As clearly shown in FIGS. 2 and 3, each of the passages 17*a* is provided with a reed type check valve 18 which allows air flow only in the direction of the associated scavenging passage 16.

In the air inlet passage 17, there is provided a control valve 19 having an actuating shaft 19*a* secured thereto. An actuating lever 20 is secured to the actuating shaft 19*a* at the outer end thereof. The lever 20 is connected through a rod member 21 with the throttle actuating lever 12. The interconnection between the throttle valve 11 and the control valve 19 is such that the control valve 19 is opened as the throttle valve 11 is opened, for example, as shown in FIG. 5.

In operation, as the piston 4 moves upwards, the volume of the crank-chamber 3*a* is increased and air-fuel mixture is charged from the intake passage 8 through the reed valve 9 into the crank-chamber 3*a*. The charge of the air-fuel mixture is then compressed in descending stroke of the piston movement and, as soon as the scavenging ports 15 are opened to the combustion chamber 1*a*, it is forced through the scavenging passages 16 and the ports 15 to flow into the combustion chamber 1*a* to scavenge the chamber by expelling combustion gas through the exhaust port 13.

According to the present invention, when the piston 4 moves upwards, air is introduced through the passage 17 and the valves 18 into the upper portions of the scavenging passages 16 while air-fuel mixture is being introduced through the intake passage 8 and the port 7 into the crank-chamber 3*a*. Thus, the air is stored in the scavenging passages 16 at the upper portions thereof and then discharged into the combustion chamber when the scavenging ports 15 are opened in the descending stroke of the piston movement. Thus, the initial part of the scavenging stroke is performed substantially by air which does not contain fuel so that it is possible to prevent unburnt fuel from being discharged through the exhaust port 13 in the scavenging stroke.

The amount of air supplied through the passage 17 into the scavening passages 16 in the piston ascending stroke is under the control of the valve 19 which is in this example interconnected with the throttle valve 11. Therefore, in the present invention, it is possible to control the amount of air supplied to the scavenging passages 16 substantially in accordance with the engine operating condition. It should be noted herein that the control valve 19 may be alternatively actuated by other means, for example, by means responsive to the suction pressure in the intake passage 8.

Figure 1:
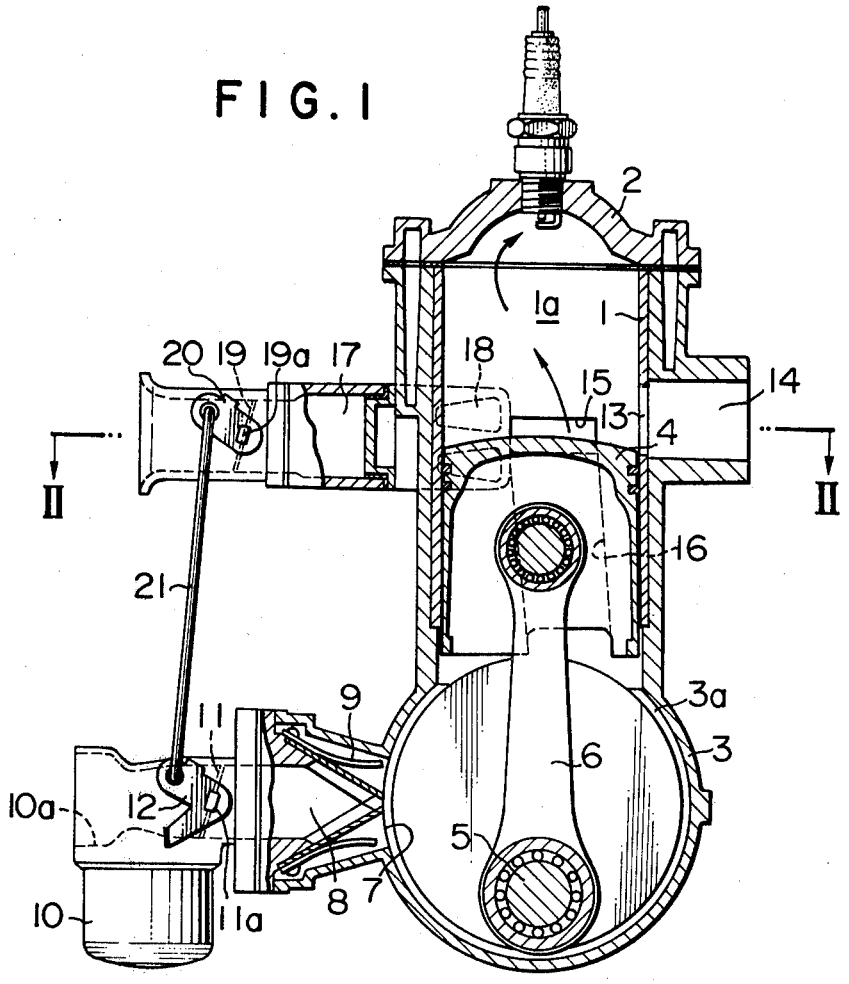
FIG. 1 is a vertical sectional view of a two cycle internal combustion engine embodying the features of the present invention.

As conventional in the art, each of the scavenging passages 16 is so formed that the scavenging flow from the passage is directed in some extent toward the side of the cylinder opposite to the exhaust port 13 to produce an effective swirl as shown by arrows in FIGS. 1 and 2. Therefore, the scavenging flow through each passage 16 is considered as being guided mostly by the wall 16*a* of the passage which is in the side adjacent to the exhaust port 13. The illustrated embodiment is advantageous in that the branched air passage 17*a* is opened to the associated scavenging passage 16 in the wall opposite to the wall 16*a* so that the scavenging flow will not be made turbulent due to the existence of the opening of the passage 17*a* to the scavenging passage 16.

FIG. 6 shows another embodiment of the present invention with corresponding parts designated by the same reference numerals as in the embodiment of FIGS. 1 through 4. This embodiment is substantially identical to the previous embodiment except that the air passage 17 is connected with the branch passages 17*a* through port openings 22 formed in the walls defining the passage 17. Reed type check valves 18 are provided for co-operation with the ports 22.

Referring now to FIGS. 7 and 8, there is shown a further example in which the present invention is embodied in two cylinder engine. As shown in FIG. 7, the engine includes two cylinders 101 which are arranged in side-by-side relationship. Each cylinder 101 has a cylinder head 102 secured to the top end thereof and a crankcase 103 provided at the bottom end thereof to define a crank-chamber 103*a* therein. A piston 104 is disposed in the cylinder 101 for slidable reciprocating movement. Thus, there is defined in the cylinder 101 a combustion chamber 101*a* of variable volume. In the crank-chamber 103*a*, there is disposed a crankshaft 105 which is connected with the piston 104 through a connecting rod 106.

Each cylinder 101 is formed with an exhaust port 113 and a pair of scavenging ports 115 located at the opposite ends of the exhaust port 113. Each of the scavenging ports 115 are connected through a scavenging passage 116 with the crank-chamber 103*a* in a manner well known in the art. The exhaust ports 113 in the cylinders 101 are in communication with an exhaust manifold 114 which is formed outside the cylinders 101. At one side of the exhaust manifold 114, there is provide a jacket 23 for cooling medium.

Each cylinder 101 is further formed with an auxiliary scavenging port 24 at the side of the cylinder 101 opposite to the exhaust port 113. The auxiliary scavenging port 24 is connected through an auxiliary scavenging passage 25 with the crank-chamber 103*a*.

As clearly shown in FIG. 7, the engine is provided with an air supply manifold 26 having a control valve 119 disposed therein. The air manifold 26 is connected respectively through air passages 117 with the upper portions of the auxiliary scavenge passage 25. In each of the air passage 117, there is provided a reed type check valve 118 to allow air flow only into the auxiliary scavenge passage 25.

In FIG. 8, it will be seen that the upper edge of the auxiliary scavenge port 24 is at a level higher than that of the main scavenge port 115 so that the former is opened earlier than the latter during the piston descending stroke. Therefore, air is introduced in each cylinder 101 through the associated air passage 117 into the upper portion of the auxiliary scavenging passage 25 in the ascending stroke of the piston movement and discharged into the combustion chamber 101*a* in the piston descending stroke before the scavenging ports 115 are opened so that the intitial stage of the scavenging stroke is performed with air substantially free of fuel contents.

In three scavenging port arrangement as in this embodiment, it is most likely that the scavenging fluid from the scavenging port opposing the exhaust port reaches and in part flows out through the exhaust port during the scavenging stroke. Therefore, in this embodiment, arrangement is made in such a manner that air is discharged through the auxiliary scavenging port 24 into the combustion chamber 101*a* in the initial stage of the scavenging stroke before air-fuel mixture is discharged. This is very effective to prevent or substantially decrease emission of unburnt fuel components during scavenging stroke.

The arrangement in this embodiment is further advantageous in that each of the cylinders 101 is oriented in such a manner that a center line A of the cross-secton of the cylinder passing through the centers of the auxiliary scavenge port 24 and the exhaust port 113 has an angle with respect to a line C which is transverse to a line connecting the centers of the two cylinders 101. It will be clearly noted that the arrangement is effective to avoid interference between the adjacent scavenging passages 116 in the adjacent cylinders 101 so that the center-to-center distance between the cylinders 101 can be substantially decreased.

Further, in a multiple cylinder arrangement, it will be very difficult in practice to associate air supply devices with the side scavenging passages 116. However, according to the invention, each cylinder 101 is formed with an auxiliary scavenging port 24 at the side opposite to the exhaust port 113 and air is very conveniently introduced into the auxiliary scavenging passage 25 leading to the port 24. Thus, the design is very simple, compact and convenient for maintenance.

Although not shown specifically in FIG. 8, the crank-chamber 103*a* is associated with air-fuel mixture intake means as in the previous embodiments. The intake means is of course provided with a throttle valve and the valve 119 is connected by means not shown in the drawings with the throttle valve.

The invention has thus been shown and described with reference to specific embodiments, however, it should be noted that the invention is in no way limited to the details of the illustrated structures but changes and modifications may be made without departing from the scope and the appended claims.

I claim:

1. Two cycle internal combustion engine comprising cylinder means, piston means disposed for sliding movement in said cylinder means and defining combustion chamber means of variable volume in one end of said cylinder means, crankcase means provided at the other end of the cylinder means and defining therein crank-chamber means having a volume which varies in response to the sliding movement of the piston means, exhaust port means formed in said cylinder means and connected with exhaust passage means, scavenging port means formed in said cylinder means, scavenging passage means having one end connected with said scavenging port means and the other end with said crank-chamber means, air passage means communicating through check valve means with the scavenging passage means for providing supply of air thereto, intake passage means communicating with the crank-chamber means and having throttle valve means provided therein, control valve means provided in said air passage means, means for actuating the control valve means so that it is opened in accordance with engine load condition, and said control valve means is connected through mechanical connecting means with the throttle valve means so that the former is opened as the latter is opened.

2. Two cycle internal combustion engine comprising cylinder means, piston means disposed for sliding movement in said cylinder means and defining combustion chamber means of variable volume in one end of said cylinder means, crankcase means provided at the other end of the cylinder means and defining therein crank-chamber means having a volume which varies in response to the sliding movement of the piston means, exhaust port means formed in said cylinder means and connected with exhaust passage means, first scavenging port means formed in said cylinder means, first scavenging passage means having one end connected with said first scavenging port means and the other end with said crank-chamber means, second scavenging port means formed in said cylinder means at such location that it is opened earlier than the first scavenging port means in descending stroke of the piston movement, second scavenging passage means having one end connected with said second scavenging port means and the other end with said crank-chamber means, air passage means communicating through check valve means with the second scavenging passage means for providing supply of air thereto, intake passage means communicating with the crank-chamber means and having throttle valve means provided therein, control valve means provided in said air passage means, means for actuating the control valve means so that it is opened in accordance with engine load condition.

3. Engine in accordance with claim 2 in which said second scavenging port means is located opposite to the exhaust port means.

4. Engine in accordance with claim 3 in which said first scavenging port means includes ports disposed at the opposite sides of the exhaust port means.

5. Multiple cylinder two cycle internal combustion engine comprising a plurality of cylinders arranged in row, a piston disposed for sliding movement in each of said cylinders and defining a combustion chamber of variable volume in one end of said cylinder, a crankcase provided at the other end of the cylinder and defining therein a crank-chamber having a volume which varies in response to the sliding movement of the piston, exhaust port means formed in each cylinder and connected with exhaust passage means, a plurality of first scavenging ports formed in each cylinder at the opposite sides of the exhaust port means, first scavenging passages one for each first scavenging port and having one end connected with the associated first scavenging port and the other end with said crank-chamber, second scavenging port means formed in each cylinder at a position opposite to the exhaust port means in such location that it is opened earlier than the first scavenging ports in descending stroke of the piston movement, second scavenging passage means having one end connected with said second scavenging port means and the other end with said crank-chamber means, each cylinder being oriented in such a manner that a line passing through centers of the exhaust and second scavenging port means makes an angle with a line transverse to a line passing through centers of the cylinders so that adjacent ones of the first scavenging passages in the adjacent cylinders do not interfere each other, air passage means communicating through check valve means with the second scavenging passage means for providing supply of air thereto, intake passage means communicating with each crank-chamber and having throttle valve means provided therein, control valve means provided in said air passage means, means for actuating the control valve means so that it is opened in accordance with engine load condition.

6. Engine in accordance with claim 1 in which scavenging passage means has first wall means which serves to guide fluid flow passing therethrough and second wall means which in effect do not serve to guide the fluid flow, said air passage means being opened to the scavenging passage means at the second wall means.

7. Multiple cylinder two cycle internal combustion engine comprising a plurality of cylinders arranged in a row, a piston disposed for sliding movement in each of said cylinders and defining a combustion chamber of variable volume in one end of said cylinder, a crankcase provided at the other end of the cylinder and defining therein a crank-chamber having a volume which varies in response to the sliding movement of the piston, exhaust port means formed in each cylinder and connected with exhaust passage means, a plurality of first scavenging ports formed in each cylinder at the opposite sides of the exhaust port means, first scavenging passages one for each first scavenging port and having one end connected with the associated first scavenging port and the other end with said crank-chamber, second scavenging port means formed in each cylinder at a position other than a portion in-between the cylinders in such location that it is opened earlier than the first scavenging ports in descending stroke of the piston movement, second scavenging passage means having one end connected with said second scavenging port means and the other end with said crank-chamber means, air passage means communicating through check valve means with the second scavenging passage means for providing supply of air thereto, intake passage means communicating with each crank-chamber and having throttle valve means provided therein, control valve means provided in said air passage means, means for actuating the control valve means so that it is opened in accordance with engine load contition.

* * * * *